United States Patent [19]

Olmstead et al.

[11] 4,236,066

[45] Nov. 25, 1980

[54] VOTING MACHINE

[75] Inventors: Charles H. Olmstead, Worcester, Mass.; James V. Simone, High Point, N.C.

[73] Assignee: Wright Line Inc., Worcester, Mass.

[21] Appl. No.: 827,589

[22] Filed: Aug. 25, 1977

[51] Int. Cl.[3] ..... G07C 13/00

[52] U.S. Cl. ..... 235/51; 235/50 R; 235/54 F

[58] Field of Search ..... 235/51, 50 R, 54 F, 235/55 R, 50 A, 54 R, 50 B

[56] References Cited

U.S. PATENT DOCUMENTS

| | | | |
|---|---|---|---|
| 3,191,859 | 6/1965 | Lord | 235/50 R |
| 3,401,472 | 9/1968 | Lord | 235/50 R |
| 3,468,477 | 9/1969 | Gray, Jr. | 235/50 R |
| 3,653,587 | 4/1972 | Hammond et al. | 235/50 R |
| 3,944,788 | 3/1976 | Comisar et al. | 235/54 F |
| 4,046,992 | 9/1977 | Huhn et al. | 235/54 F |

FOREIGN PATENT DOCUMENTS

| | | | |
|---|---|---|---|
| 706250 | 3/1965 | Canada | 235/50 R |

*Primary Examiner*—L. T. Hix
*Assistant Examiner*—Benjamin R. Fuller
*Attorney, Agent, or Firm*—Milton E. Gilbert

[57] ABSTRACT

Voting machine or system for both punching holes in a ballot and at the same time accumulating the votes. The ballots are fed into the machine, locked in place, and then tests are made to determine if the ballot is valid. If the ballot is valid, voting is accomplished by the user punching holes in the ballot. The punching of holes also produces storage of the vote which is thereafter accumulated in the machine after the ballot is approved by the voter. The machine also includes means to permit a voter to detect the he or she has overvoted a ballot and thus produced an invalid ballot so that a new ballot may be taken and voted.

13 Claims, 49 Drawing Figures

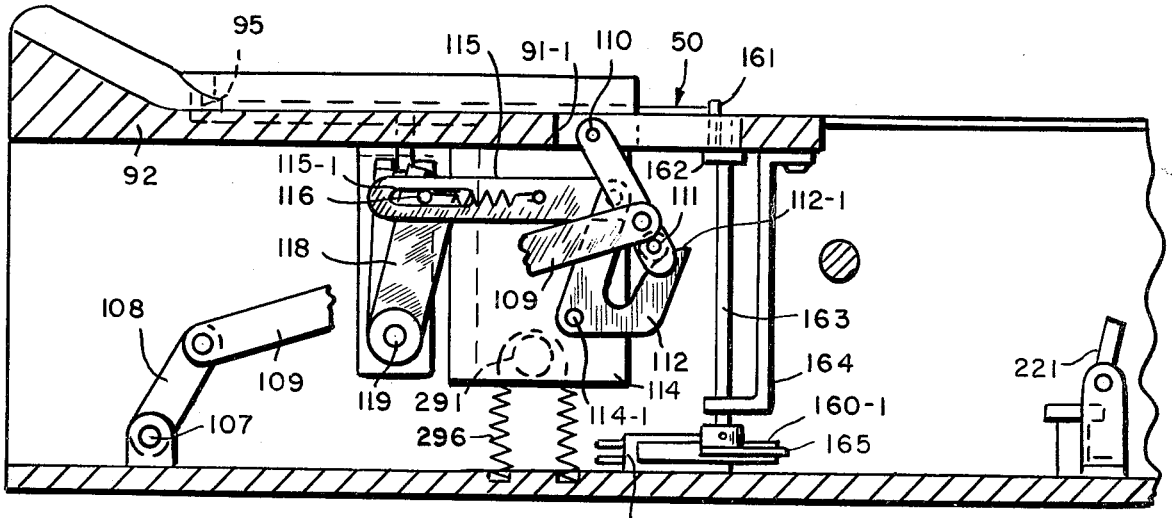
FIG. 11
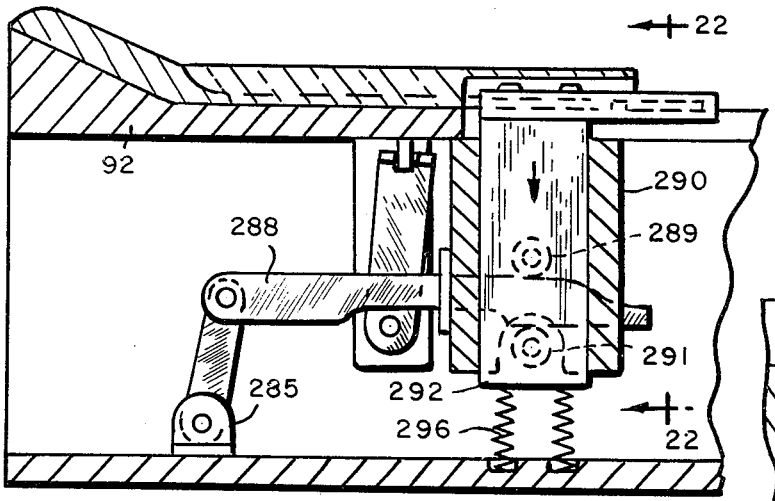
FIG. 21
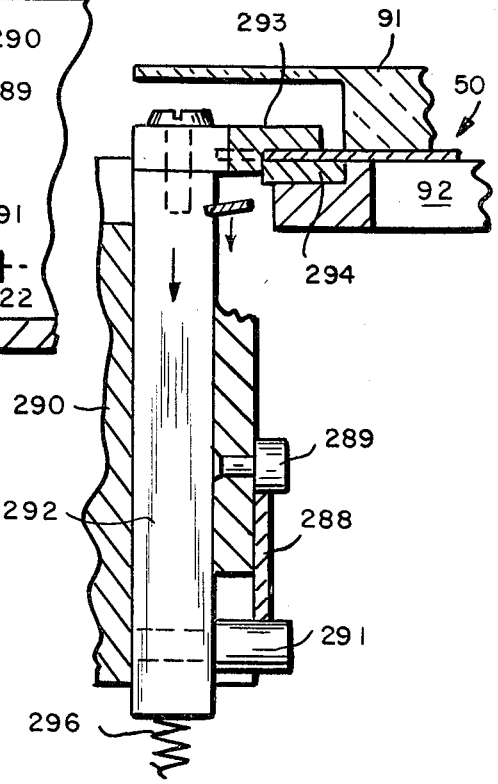
FIG. 22
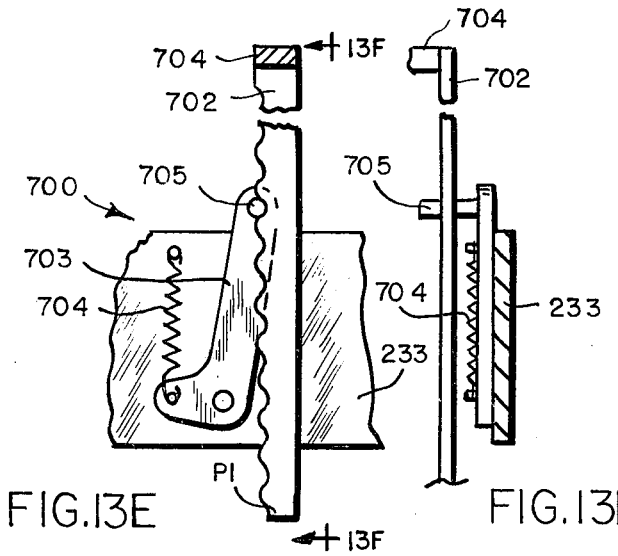
FIG. 13E
FIG. 13F

VOTING MACHINE

BACKGROUND OF THE DISCLOSURE

The most common methods of voting are with machine, punched cards, and hand marked ballots. Voting machines are generally in use in larger population centers, however, they are relatively large and expensive devices and thus have not been accepted for use in smaller communities. The size of voting machines are generally in the order of 24 cubic feet, their weights is several hundred pounds and the cost is about three thousand dollars.

The user of such a machine sets mechanical switches for the candidates for whom he or she wishes to vote and at the end of the selection process the total vote is cast simultaneously and the votes are generally accumulated mechanically.

There is no physical record for each individual voter because no ballot as such is used. The advantage of voting machines is that the total vote for each candidate is readily computed at the precinct level and additionally mechanical interlocks can be preset so that a voter cannot overvote any particular office. The disadvantages of voting machines are those of cost, storage, cost of set-up, and the lack of a ballot which provides no audit trail.

Another widely used method for voting is the use of punched cards with or without pre-scored holes. The disadvantage of pre-scored cards is the relatively high cost and that the pre-scored regions sometimes fall out thereby producing an unintended vote. The advantage of a punched card system is that there is an audit trail, however, counting must be done at a central location unless there are card reading devices at the precinct level, which is a relatively expensive proposition.

Also with existing punched card systems there is no way to prevent voters from overvoting for a position e.g., voting for both candidates for an office.

While the overvoted ballots can be checked for correctness, there is no way to prohibit overvoting in the first instance.

The other prevalant voting technique still used in many small communities is the paper ballot.

The present invention provides advantages over the prior method in that it provides a hard copy and also enables the precinct or polling place to tabulate votes of all the machines on site without having to resort to a central counting mechanism.

This invention has the advantage over conventional ballot systems in that a voter can be informed that he or she overvoted i.e., voted for too many candidates, or yes and no for a proposition, referendum, etc., and thus produced an invalid ballot. With this invention the voter can choose another ballot and vote once again, hopefully not making the same error again.

The following patents are hereby cited to apprise the Patent Office of related art; U.S. Pat. Nos. 3,277,757, 3,240,409, 3,236,466, 3,226,019, 3,220,292, 3,191,859, 3,214,092, 3,170,622, 2,364,097, 1,947,157, 1,081,314, 3,846,718, 3,881,092, 1,410,984, 3,401,472, 3,286,918, 3,653,587, 3,468,477, 496,965 and 431,600.

BRIEF DESCRIPTION OF THE DISCLOSURE

This invention is directed to a new and improved voting machine or system which provides at the voting site both a total of the votes case, as well as a ballot representing each of the votes cast.

The machine provides means to determine if a ballot has been overvoted i.e., a voter selected too many options e.g., selected too many candidates or voted yes and no for a referendum as well as means to determine if a ballot is initially valid, i.e., one which has not been previously voted, invalidated, or is an incorrect ballot for this machine e.g., has the wrong candidates listed for this precinct.

As one of the features of system, step by step operating instructions are provided to the user to facilitate voting.

The system also includes means for marking the ballot after it has been voted or for voiding the ballot if the voter voted for the wrong candidate and wishes to take a new ballot and vote once again.

BRIEF DESCRIPTION OF THE DRAWINGS

FIG. 11 is a sectional view taken along line 11—11 in FIG. 7;

FIGS. 13E annd 13F are side and top view of a rough indexing guide used in this machine for locating the punch;

FIG. 21 is a sectional view taken along line 21—21 on FIG. 14 to illustrate the vote punch on the ballot corner;

FIG. 22 is a sectional view taken along line 22—22 in FIG. 21;

DETAILED DESCRIPTION OF THE DISCLOSURE

Figure 1:
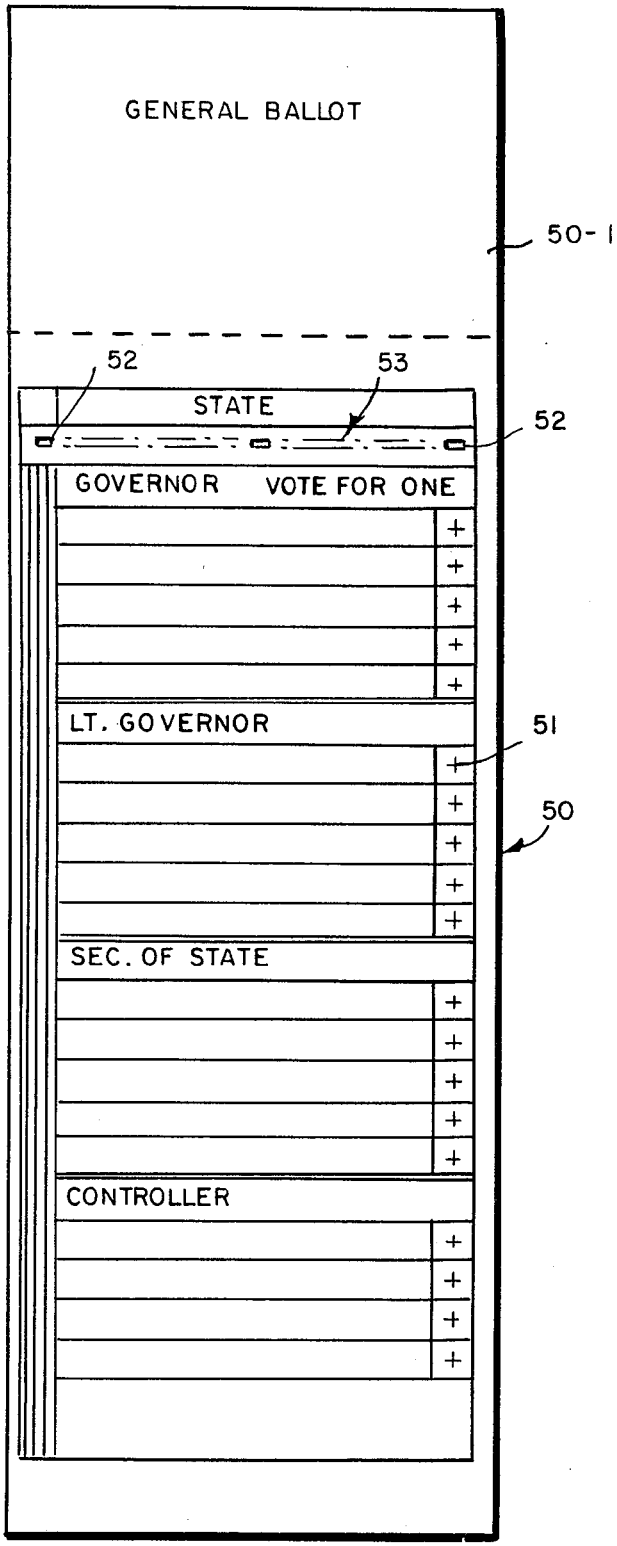
FIG. 1 is a plan view of a ballot prior to use.
Figure 2:
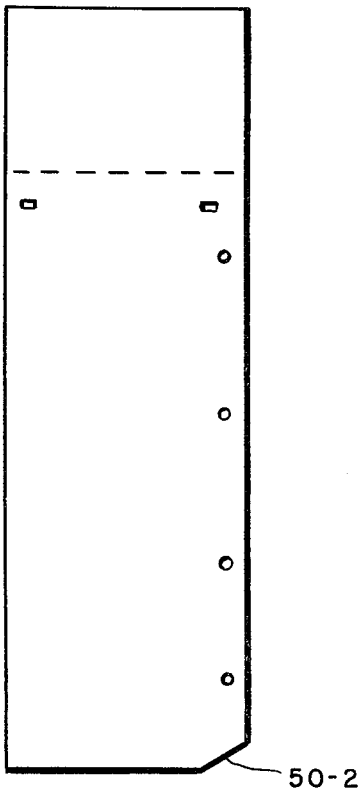
FIG. 2 is a plan view after a vote has been cast (holes+corner cut)
Figure 3:
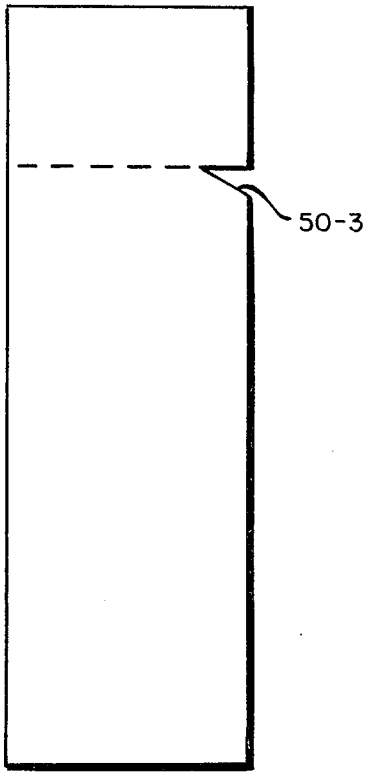
FIG. 3 is a plan view of a ballot that has been voided with top notch.

Reference should now be had to FIGS. 1-3 for a typical preferred general ballot or card 50 prior to insertion into the machine. The card typically shows the offices and the candidates running for the office. Instead of candidates, propositions or referendum may also appear on the ballot or as part of the ballot. The card has boxes 51 at the right in which holes may be punched to signify the candidate and/or referendum being selected.

Each card also preferably has holes 52 positioned to represent a code in area 53 which may be sensed to set the counters, the voter accumulates and to identify the memory position to which the votes are to be transferred when the voting process is completed. These holes may also be coded so that it can be sensed if the ballot is a correct ballot for this machine i.e., for the voting district. Provision is made by use of perforation to remove stub 50-1 from the card body if desired.

FIG. 2 is a view of the ballot after it has been voted and a bottom corner notch has been made at 50-2 in the ballot to indicate if it has been voted.

FIG. 3 is a view after the ballot has been voided for any reason. A void notch is provided at 50-3.

Figure 4:
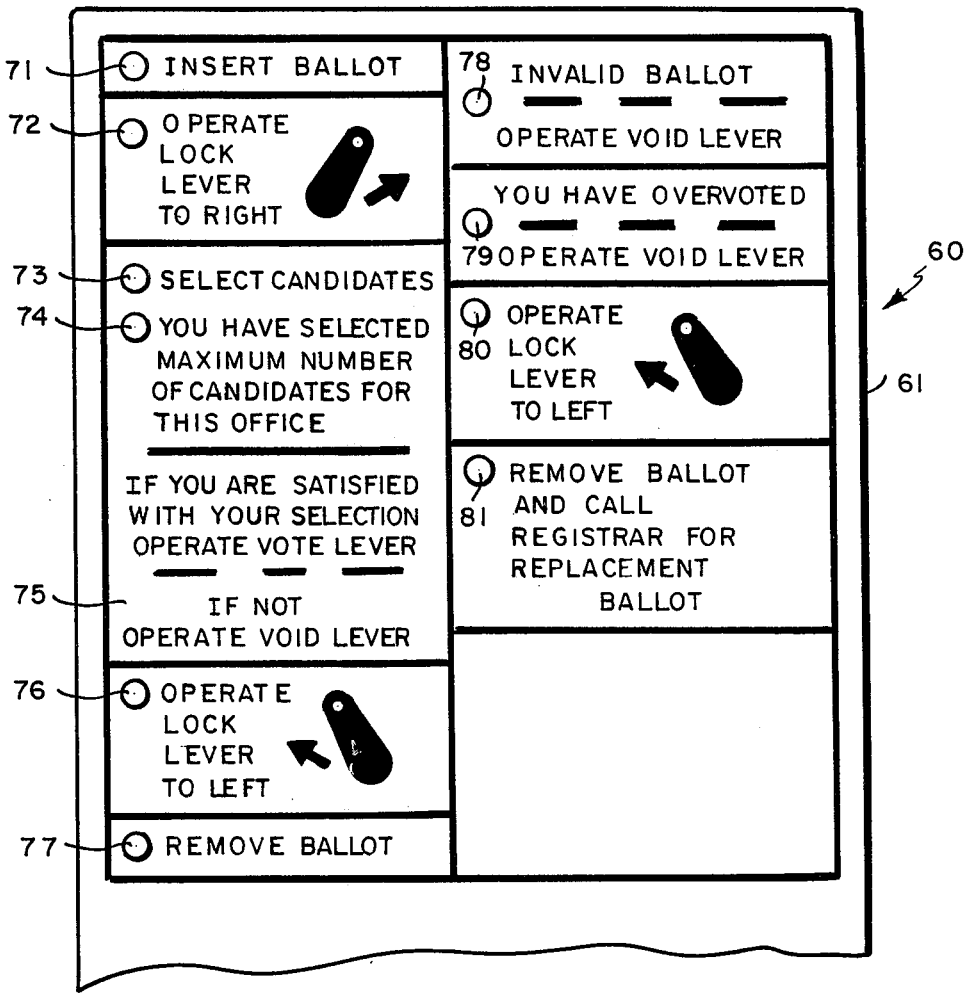
FIG. 4 is a plan view instruction display for the voter.
Figure 4A:
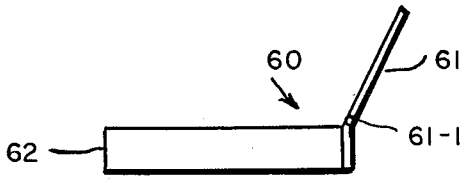
FIG. 4A is a schematic side view showing the voting machine.
Figure 5:
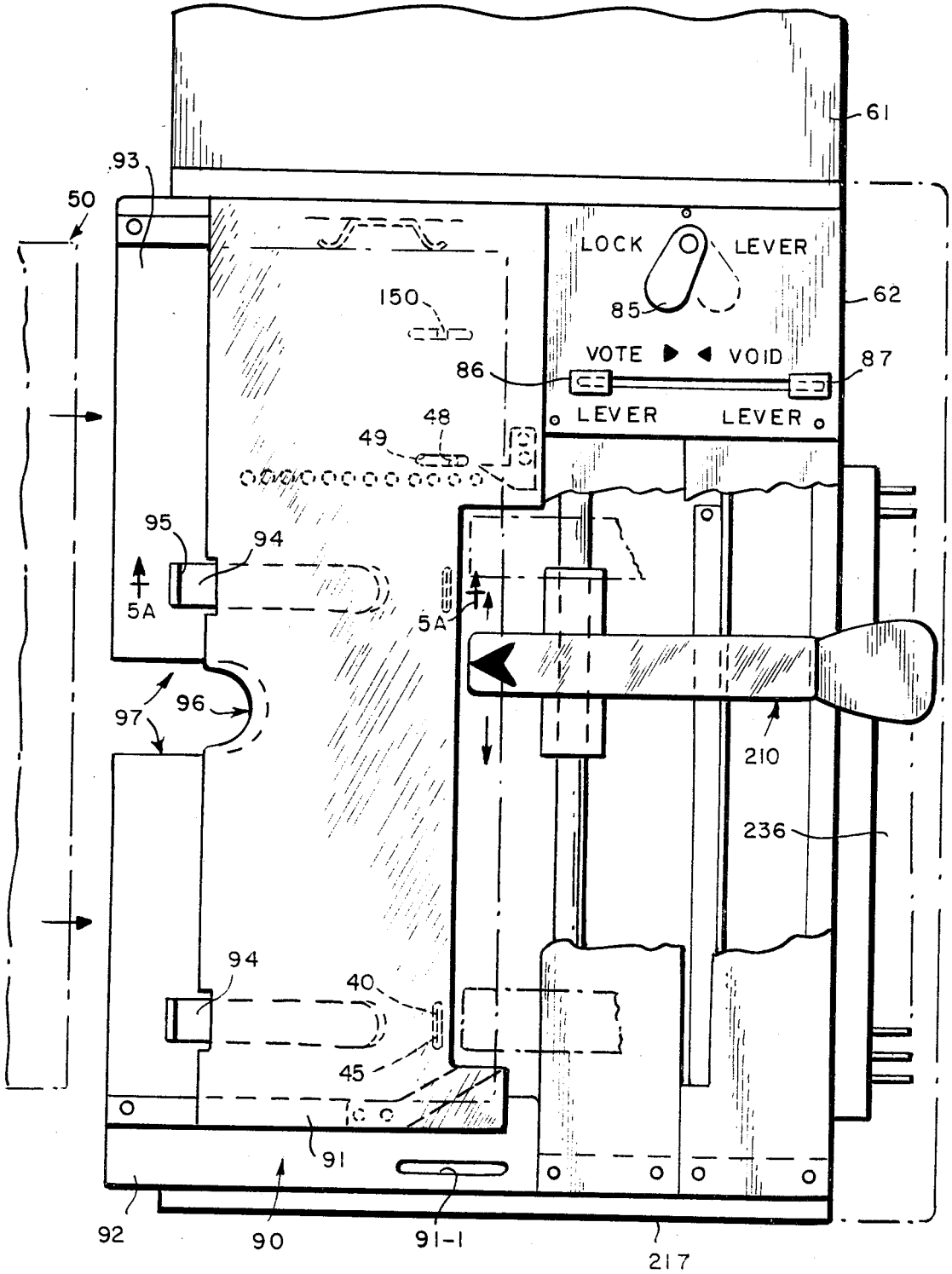
FIG. 5 is a plan view of a voting machine with cover portions broken away.

At this time reference is had to FIGS. 4 and 5 which illustrate the layout of the preferred embodiment of the voting machine 60. The machine has an upright display panel 61 attached to the top end of the frame 62 supporting the operating part of the machine (see FIG. 4A). The display panel 61 is hinged 61-1 to fold for storage.

The instructions for the voter are presented on the display panel 61 and lights e.g., light emitting diodes (LEDS) are associated with operating instructions to assist the voter. The lights are shown at 71 to 81. Light 71 will initially be on after the machine is plugged in to indicate that the machine is ready to receive a ballot. After the ballot is inserted into the machine, the light 72 will go on and light 71 goes off to indicate that the lock lever 85 (see FIG. 5) should be rotated to the right to position the ballot in the machine for voting.

Assuming that the ballot is valid for the machine i.e., the ballot has not been previously voted, and/or invalidated, the select candidates light 73 will go on and light 72 will go off to indicate that the voter may now vote.

During voting for each office, light 74 (a flashing light) may periodically turn on to indicate that the voter has selected the maximum number of candidates for a particular office. When this occurs the voter will now know that he or she should move on to vote for candidates for a different office.

Figure 13C:
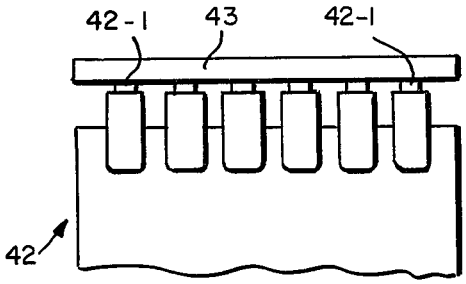
FIG. 13C is a view of the contactor and contact strip from the right of FIG. 13B.
Figure 13B:
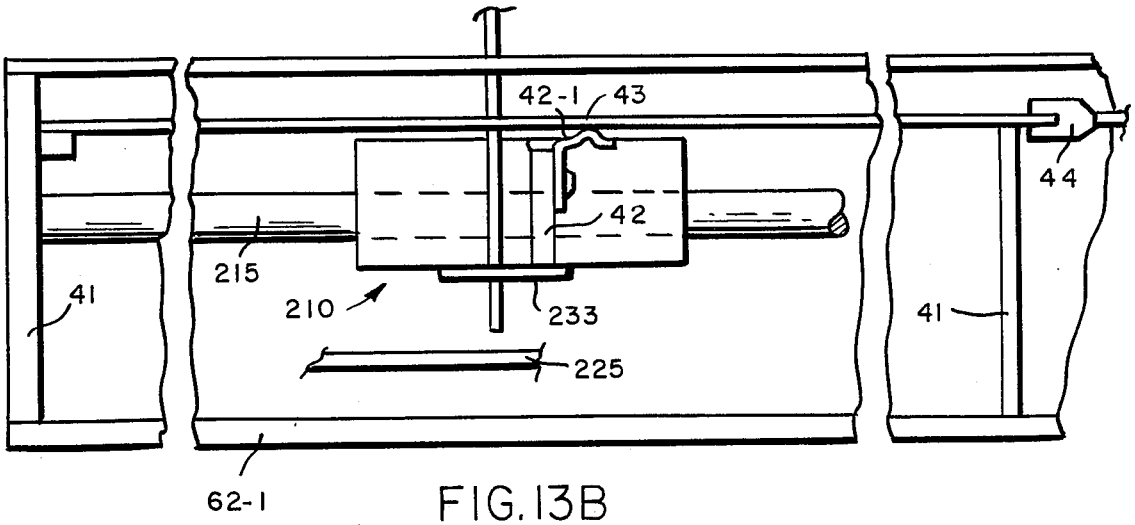
FIG. 13B is a view taken from the right side of FIG. 13A.
Figure 13D:
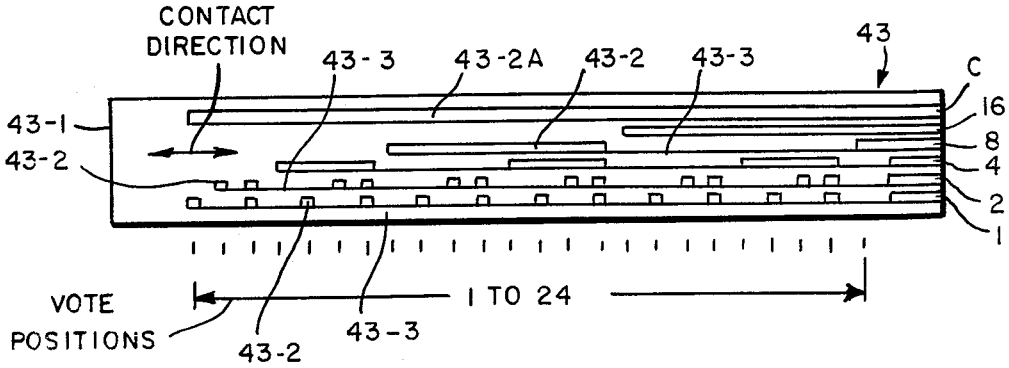
FIG. 13D is a plan view of the coded contact strip.
Figure 13A:
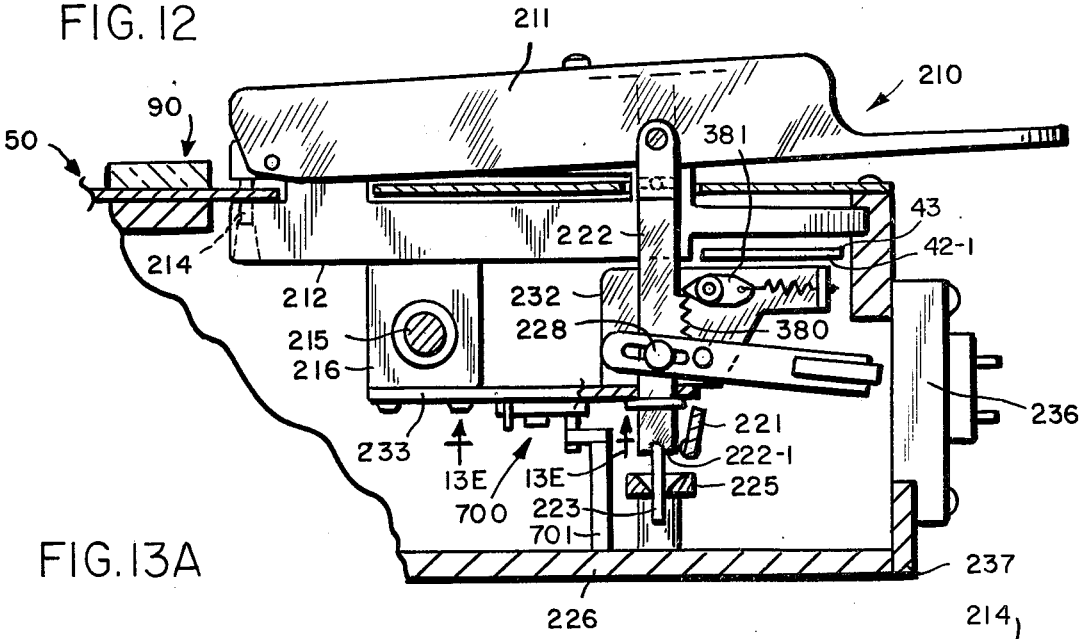
FIG. 13A is a sectional view similar to FIG. 12 showing the ballot card being punched and the count switches (magnetic read switches) being actuated as well as a punch head position locating contacts, contactor strip assembly.
Figure 12B:
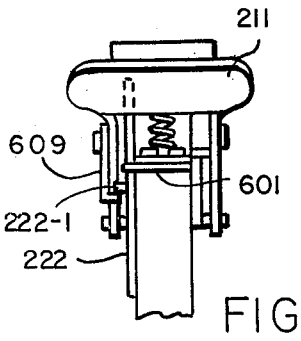
FIG. 12B is a left handed view of FIG. 12A.
Figure 12A:
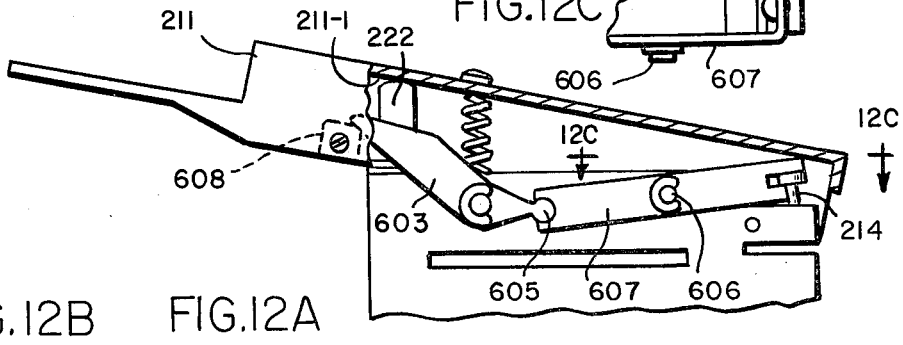
FIG. 12A is a partial sectional view taken along line 12A-12A in FIG. 7.
Figure 12C:
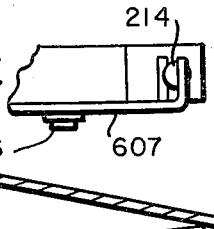
FIG. 12C is a view taken along line 12C—12C of FIG. 12A.

When the voter moves the punch-head to the vote on candidates for the next office, light 74 will go out. If the voter inadvertently returns to the already maximum voted office, light 74 will again flash. This action is controlled by monitoring the position of the punch 210 e.g., by means of a binary-decimally coded contact strip 43 see FIGS. 13A,B,C and D. The strip is mounted on insulated supports 41 (see FIG. 13B) attached to the base 62-1. A six fingered contactor 42 (FIGS. 13B and 13C) is fixed to the punch-head assembly 210 and aligned such that its fingers 42-1 slide along the underside of coded contact strip 43, where each of the 24 possible positions is delineated (see FIG. 13D). Logic e.g., a microprocessor learning of the maximum vote for each office by the coding in area 53 of the ballot being voted at that time and associates this with the position of the punch head assembly 210 or fixed preset and hand wired logic (manually set) may be used to accomplish same, see FIGS. 32-36 without the strip and contacts in the case of one office.

Power is provided by the sliding contacts all coupled together and to common path 43-2A. An interconnecting plug 44 having 6 contacts may be used to feed the information to the logic to determine the position of the punch head assembly 210.

When voting is complete or at any time the voter wshes, the voter may operate the vote lever 86 if he or she is satisfied with the ballot as marked or he or she may operate the void lever 87 if he or she is dissatisfied with the ballot as marked.

After the vote lever or void lever is activated, light 76 now turns on to indicate that the lock lever 85 should be rotated to the left to release the ballot at the completion of voting.

The right hand side of the console, lights 78-81 (all flashing) is delineated for error or invalid situations.

Light 78 (flashing) is used to indicate that an invalid ballot has been placed in the machine and that the void lever 87 FIG. 5 should be operated. When it has been operated, light 80 will come on.

Light 79 (flashing) comes on in the event that the ballot has been overvoted e.g., too many candidates have been voted for an office or the voter has voted both yes (for) and no (against) on a referendum question. The voter should operate the void lever 87, FIG. 5 after which light 80 (flashing) will come on. Light 80 is used to indicate that the lock lever should be moved to the left after which light 81 will come on to indicate that the voter should remove the ballot.

Light 80 and light 81 (flashing) are placed under lights 78 and 79 so that the voter will note the sequence of operations required in order to remove the ballot.

Reference should now be had to FIG. 5 which shows the layout of the machine. The ballot is shown at 50 prior to being placed in a ballot receiver 90 having a transparent top plate 91 and bottom plate 92 defining a receptacle 93 therebetween in which the ballot 50 is placed.

When the ballot is inserted, it is stopped by stops 45 FIG. 5 which protrude through cavities 46 in the card bed. When the ballot is against the stops 45, it is in position to be engaged by fingers 94. Fingers 94 having an upward raised flange 95 are provided for pulling the ballot into position for voting. The fingers 94 are operated by the lock lever 85 and a finger recess 96 is provided to push in or pull out the ballot 50, by grasping same between two fingers to move same over the sloping portion 97 of the ballot receiver 90.

Figure 6:
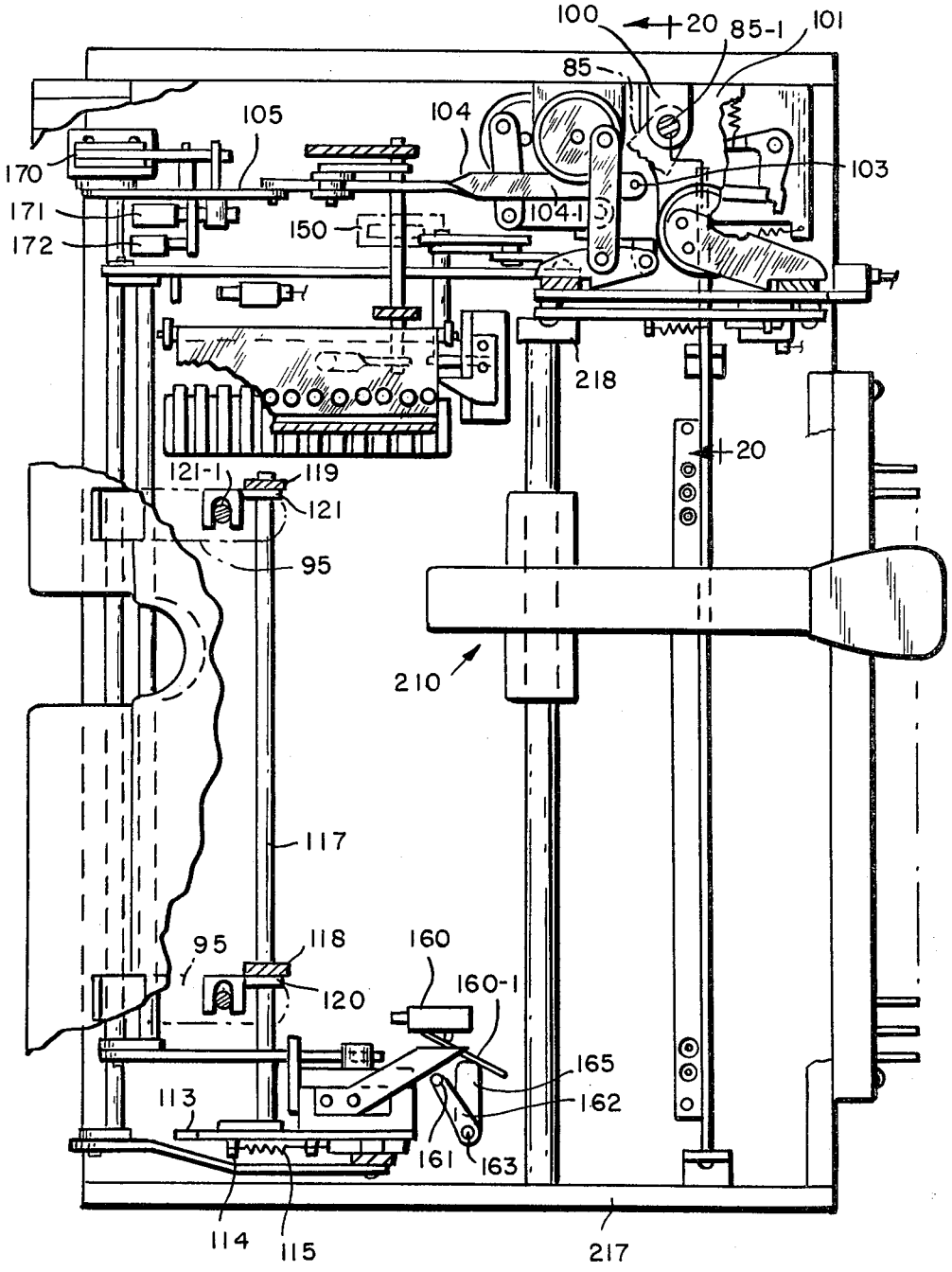
FIG. 6 is a plan view with the covers removed and parts broken away.
Figure 7:
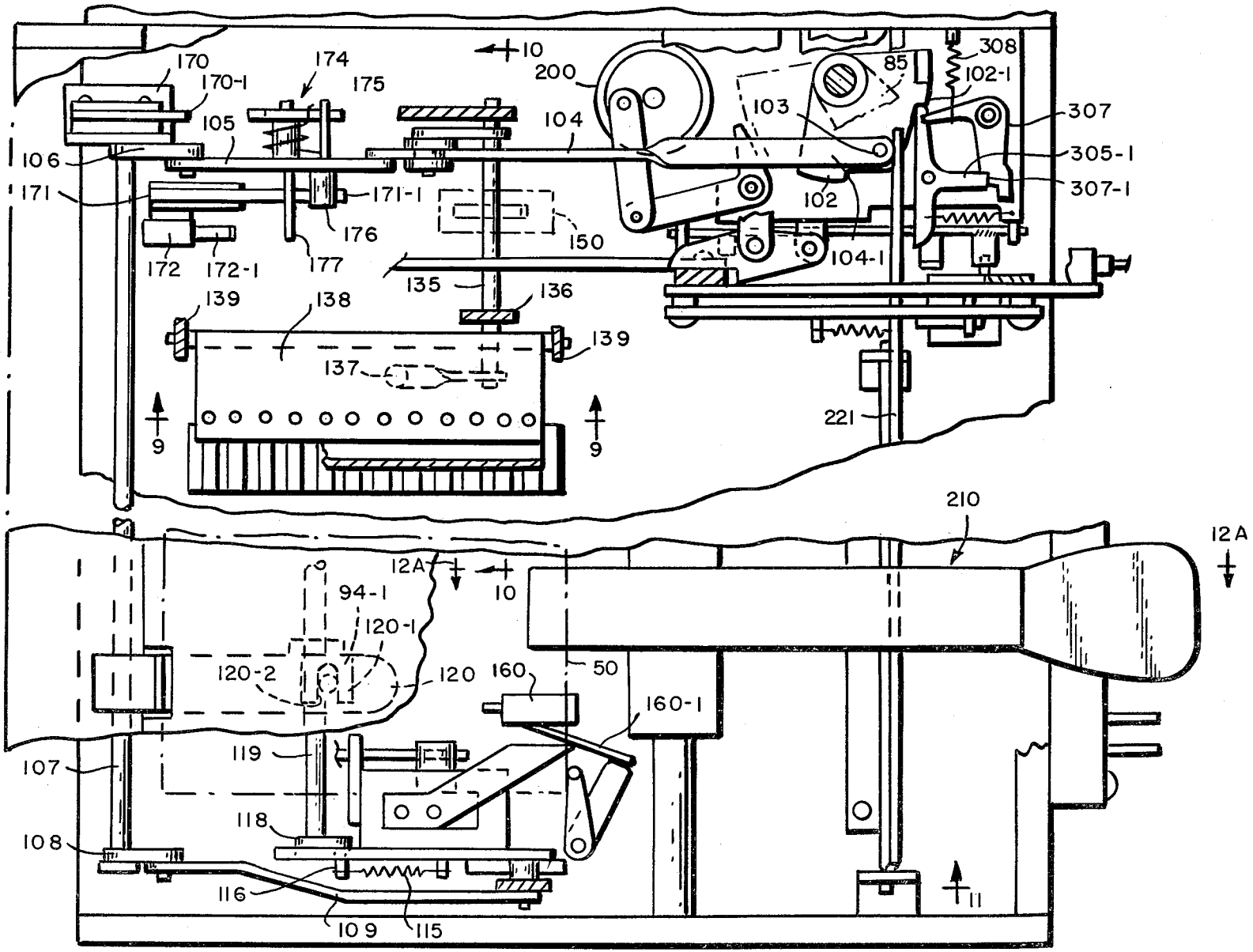
FIG. 7 is an enlarged plan view similar to FIG. 6 with parts broken away, and with lock lever in voting position.
Figure 16:
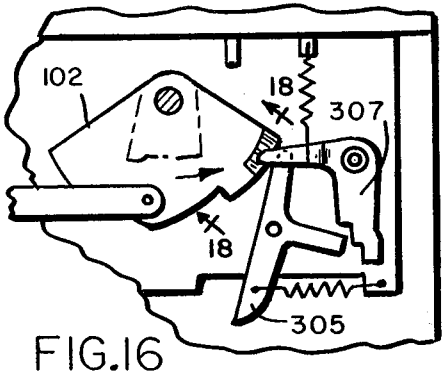
FIGS. 16 and 17 show the camming action on finger pawl to lock the lock lever in place.
Figure 15:
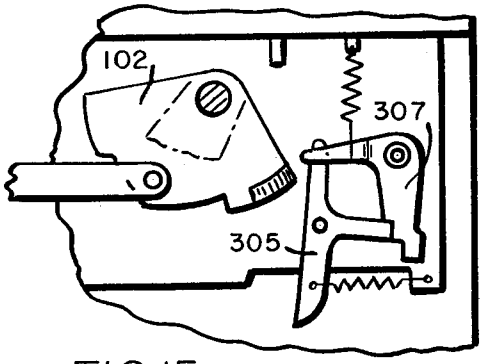
FIG. 15 is a top plan view of the lock lever after return.

In FIGS. 6, 7 and 11 the mechanism connecting the fingers 94 to the locking lever is shown. This comprises a shaft 85-1 which is supported by a flange 100 and which is supported at its bottom by a second flange 101. The shaft 85-1 supports a segment 102 for rotation therewith which has a pin 103 mounted thereon. The pin 103 is connected to links 104-15 which rotate a lever 106 coupled to a pivotally mounted shaft 107.

The shaft 107 is coupled to a lever 108 which in turn drives a link 109 which is pivotally connected to a link 110. In particular, link 110 has one end positioned in slot 91-1 (see FIG. 5) and is pivotally coupled to the interior of the slot and referring to FIG. 11, the other end is coupled to a cam roller 111 which rides on lever 112 of cam portion 112-1. The lever 112 is pivotally connected to a punch housing 114 at pivot 114-1.

The lever 112 has a link 115 coupled to it at the upper end and is in turn coupled through a slot 115-1 to a pin 116 that extends through the slot and spring, loaded by spring 117 which acts as an over-ride to prevent injury to voter's fingers by locating fingers 94.

The lever 118 containing the pin 116 is coupled to a shaft 119 which has two levers 120 coupled thereto. The levers 120 have a flange 120-1 which is slotted at 120-2 to receive a pin 94-1 extending downwardly from finger 94 into slot 120-2. Thus the rotation of the lock lever 85 to the right causes the card to be brought into place for voting by the translation of fingers 94 to the right of FIG. 5.

Figure 5A:
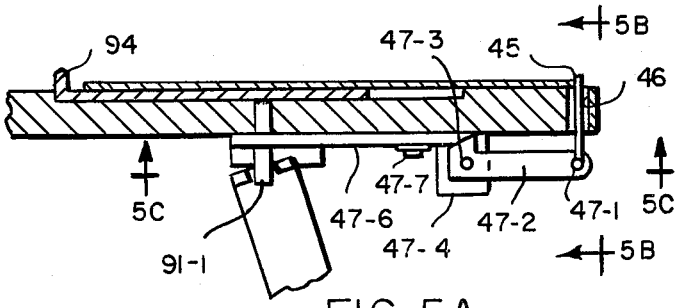
FIG. 5A is a proportional sectional view taken along line 5A—5A in FIG. 5.
Figure 5B:
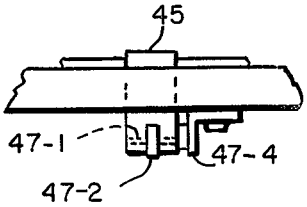
FIG. 5B is a view taken along line 5B—5B in FIG. 5A.
Figure 5C:
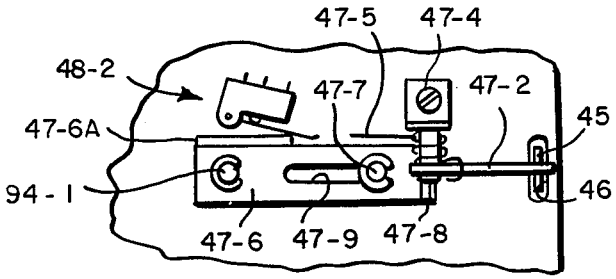
FIG. 5C is a view taken along line 5C—5C in FIG. 5A.

As the fingers 94 move to the right, a mechanism FIGS. 5A,5B and 5C retracts stops 45 so that the ballot can also move to the right. Stop 45 is attached to but free to rotate around pin 47-1 of bellcrank 47-2. Bellcrank 47-2 rotates around pin 47-3 which is part of bracket 47-4. Spring 47-5 surrounds the shoulder of pin 47-3 and engages the bellcrank 47-2 so that stop 45 is urged upward. Cam plate 47-6 is secured to the base by pin 47-7 and its snap ring.

Plate 47-6 also is attached to finger 94 by means of pin 94-1 and a snap ring. As finger 94 moves to the right, cam plate 47-6 follows it sliding along on pin 47-7 and slot 47-8. Immediately after cam plate 47-6 moves, a cam surface 47-9 engages the short end of bellcrank 47-2 forcing it to rotate, thereby lowering stop 45 so that the ballot 50 slides over.

The rotation of the lock lever 85 to the right also causes code sensing pins 130 (see FIGS. 6, 7, 9, 10 and 10A) to be raised to sense the code determined by holes 52 in the card area 53 (see FIG. 1) of card 50. In place of the code sensing pins photodiodes (sensors) and associated light sources therefore positioned to sense the presence or absence of holes may also be used. The sensors may operate in the reflecting or direct sensing mode.

The lever 104 coupled to lock lever 85 is provided with a cam surface 104-1 which rides between a fixed roller 131 which is attached to an L shaped bracket 132 which is secured as shown to the bottom plate 92.

A cam roller 133 which rides on the cam surface 104-1 is connected to lever 134 which is coupled to shaft 135. The shaft 135 is supported by an L shaped bracket 136 and the L shaped bracket 132 for rotation.

The end of shaft 135 is connected to a 90° twist lever 137. The twist lever 137 is coupled to a pin through control plate 138 which is pivotally connected on either end for rotation to brackets 139. The plate 138 is provided with a plurality of slots 138-1 which engage the central rectangular portion of the pins 130 (see FIG. 9).

Figure 9:
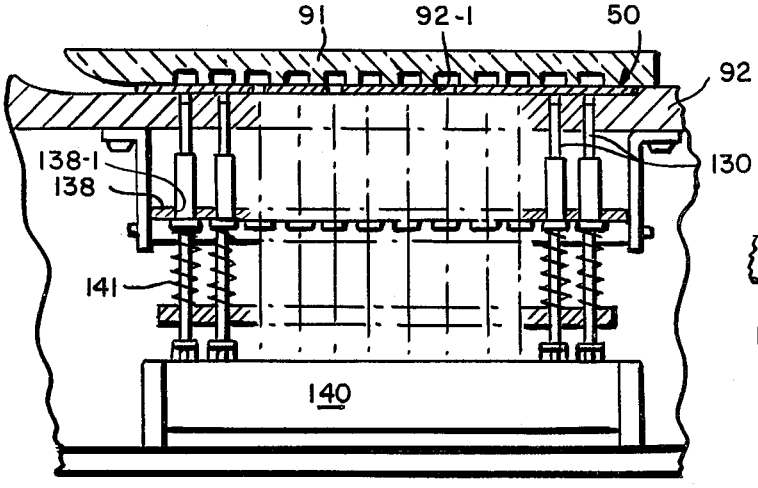
FIG. 9 is a sectional view taken along line 9—9 in FIG. 7.

In FIG. 9 the top of the sensing pins 130 are shown positioned in holes 92-1 in bottom plate 92. The bottom of each of the pins is in contact with its own sensing switch 140 having sensing leaf 140-1.

When a card 50 is properly positioned and locked in place, and the lock lever 85 is rotated counterclockwise (to the right) the pins are raised to attempt to go through the card code program holes 52.

Only where the hole 52 is present can the pin be urged through the hole by the springs 141 which are released by the upward movement of plate 138. Thus, a coded output of electrical signals will be obtained from switches 140 since where there is a hole 52 in card 50, the leaf 140-1 will rise and where there is no hole the card will hold the pin from rising off the leaf 140-1.

Figure 10A:
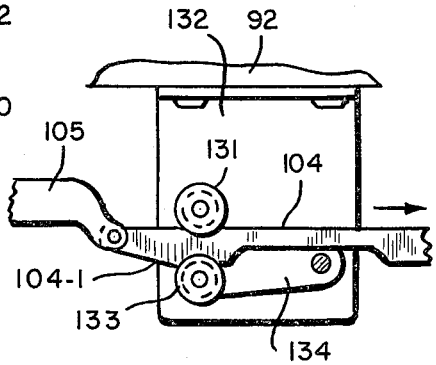
FIG. 10A is a sectional view taken along line 10A—10A in FIG. 10.
Figure 10:
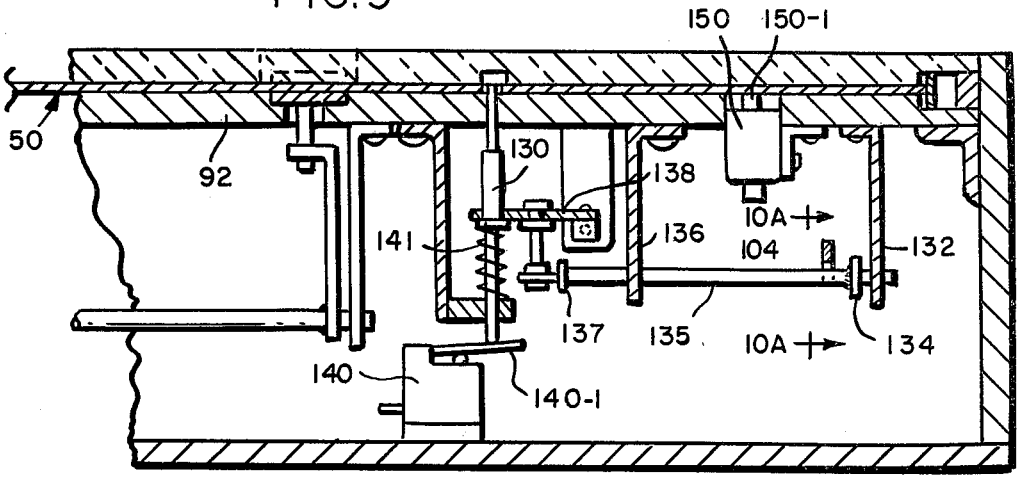
FIG. 10 is a sectional view taken along line 10—10 in FIG. 7.
Figure 23:
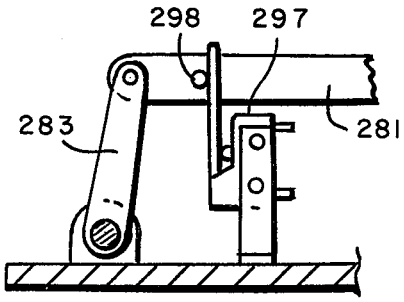
FIG. 23 is a sectional view taken along line 23—23 in FIG. 14 showing the vote lever actuating a microswitch to indicate that the ballot has been voted.
Figure 20:
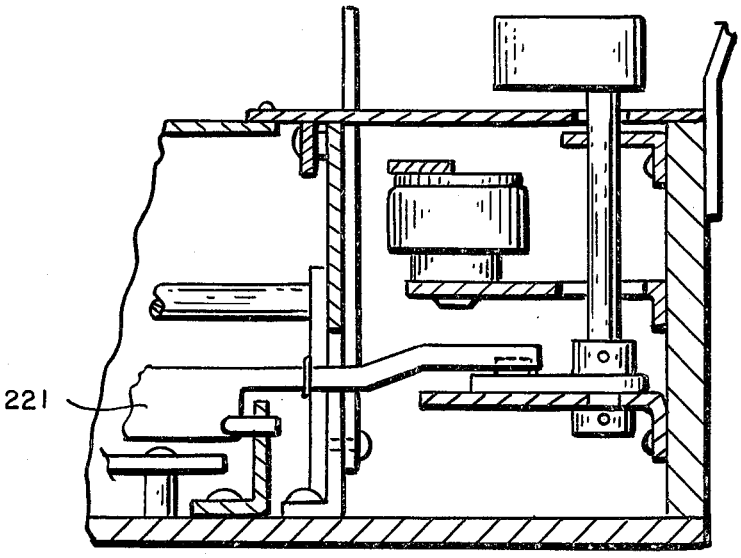
FIG. 20 is a sectional view taken along line 20—20 to show punch release bar operation due to operation of the lock lever to the right.

A sensing switch or card bed switch (SW1) 150 is also shown in FIGS. 5 and 10 for determining if a card has been inserted into the card receiver 90. The switch 150 has a sensing leaf 150-1 which is urged downwardly upon insertion of the card. Another sensing switch is provided at 160 which has a leaf 160-1. This switch (SW2) 160 is shown in FIG. 6 without a ballot to be voted and in FIG. 7 with the ballot 50 in place and without a vote notch.

The mechanism for sensing the vote notch comprises a card sensing pin 161 which is coupled to a lever 162 coupled to a vertical shaft 163 and is supported for rotation at both ends by plate 92 and a bracket 164. The lower end of shaft 163 has a switch actuating lever 165 which contacts leaf 160-1 of switch 160. Upon insertion of the ballot which has not been voted as in FIG. 7, the leaf 160-1 is rotated counterclockwise to actuate the switch.

If a voting notch is present as shown at 50-2 in FIG. 2 and the ballot is inserted as in FIG. 7, the switch leaf is not actuated as in FIG. 6. The mechanism for sensing a void notch is shown on FIGS. 5 and 5C. When the voter inserts a ballot, the ballot is stopped by stops 45. At this time switch 150 is closed and the console instructs the voter to operate the lock lever to the right. If a void notch is present, switch 48 whose leaf extends through cavity 49 will not be closed when the fingers start to move the ballot to the right. As soon as the fingers move, the raises edge 47-6A of cam plate 47-6 actuates switch 48-2 which initiates a test signal to test the condition of switch 48. If a void notch is present, switch 48 will be normal and will indicate an invalid situation.

Reference should now be had to FIGS. 6, 7 which illustrates the mechanism on lever or arm 105 which is movable by rotation of lock lever 85 which moves arm 104. Adjacent to arm 105 there is provided three switches 170 (SW6) 171 (SW3), and 172 (SW7) having actuable leafs 170-1, 171-1 and 172-1. Switch 170 is used to provide a signal to transfer the votes stored by a storage buffer register into a total vote accumulator to be described.

The switch 170 is actuated by a spring pawl unit 174 having a spring loaded pawl 175 only on the return stroke of the lock lever 85.

On the forward stroke, the leaf 170-1 is not depressed because the spring pawl rotates over the leaf.

Switch leaf 171-1 is actuated on the forward stroke of lever 85 i.e., when it is moved to the right, by the action of pin 176 coupled to arm 105.

This switch is used to indicate that the voting lock lever 85 is in the vote position i.e., to the right. Switch 172 is used to cut off power to a solenoid 200 upon moving the lock lever 85 to the right (see FIG. 7).

To accomplish this a pin 177 is provided on arm 105 which normally maintains switch 172 leaf 172-1 in a closed position as shown in FIG. 6 and releases the leaf 172-1 upon movement of the lock lever 85 to the right.

Figure 12:
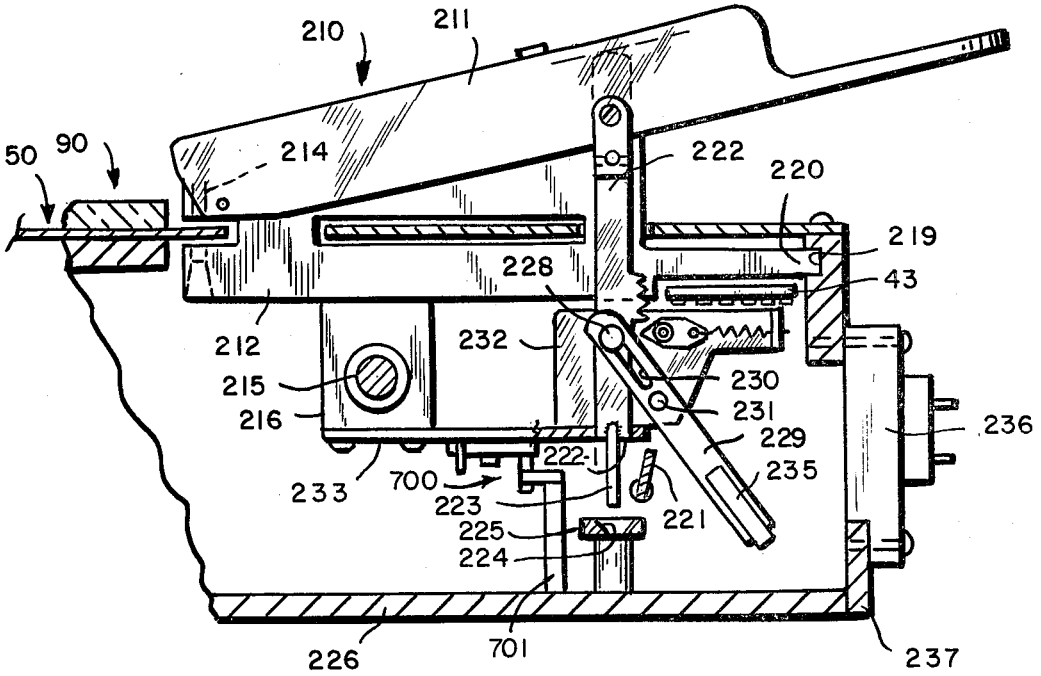
FIG. 12 is a sectional view taken along line 12—12 in FIG. 7 to illustrate the punching mechanism at rest.

At this time assuming the ballot or card 50 is now locked in place for voting, a punch 210 is shown in FIGS. 5, 6, 7, 12, 13 and 20. The punch comprises a handle 211 pivotally mounted on a body 212 which has a slot 213 for receiving the ballot 50 to punch holes at 51 (see FIG. 1). The punch has a plunger or head 214 which is actuated by handle 211 as shown in FIG. 12.

In FIGS. 12, 12A to 12C and 13A lever 222 is contained along side of punch assembly by slotted retainers 601. When handle 211 is depressed, lever 222 is immediately forced downward by the inside of handle 211, surface 211-1. As handle 211 nears the bottom of its stroke, surface 211-1 contacts lever 603, pivoted about 604. Lever 603 engages lever 607, which pivots at 608, and at point 605. Lever 607 has a forked end which captures the head of punch 214. After the hole is punched, the punch is positively retracted by levers 603 and 607 by means of block 608 attached to the inside of handle 211. Lever 222 is also retracted positively by member 609 attached to handle 211, acting on pin 222-1 which is part of lever 222.

The punch 210 is slideably mounted on rod 215 by a bearing block 216 so that it may be moved back and forth along the length of the voting area of the ballot.

The rod 215 is mounted between end wall 211 and block 218. The punch 210 is also guided by means of a square slot 219, by way of a tongue 220. The punch 210 is normally disabled by means of a rotatable horizontal bar 221.

The lever 222 has a pointed end 223 which is movable into holes 224 formed in an indexing guide 225 which is mounted to the base 226 of the machine. The horizontal bar 221 is normally into engagement with shoulder 222-1 of lever 222 as shown in FIG. 12 (dotted line). The locking bar 221 is moved to the right (unlocked position) as in FIG. 12 by the action of arm 104 and 104-1 which rotates the bar 221 to the unlocked position upon rotation of lock lever 85 fully to the right.

Attached to the lever 222 is a headed pin 228 which extends through a lever 229 having a slot 230. The lever 229 is pivoted about a pivot pin 231 which is fastened to bracket 232 which is coupled to a horizontal plate 233 which is coupled to punch block 216 for movement therewith.

At the end of lever 229 there is provided a magnet 235 which is rotated upon depression of handle 211 to a position as shown in FIG. 13 to actuate magnetic read switches 236 of a bank which is supported in the side wall 237 of the machine.

Thus upon punching of a hole in the ballot, one of the reed switches 236 of the bank is actuated to thereby provide an electrical signal indicating a vote has been made by the voter. The closing of the reed switch increments a counter and causes storage of the vote in an appropriate buffer location of a buffer register.

Assuming now that a voter has cast all the votes desired by punching the ballot, the voter can now move either the vote lever 86 or void lever 87 (see FIG. 5).

Figure 14:
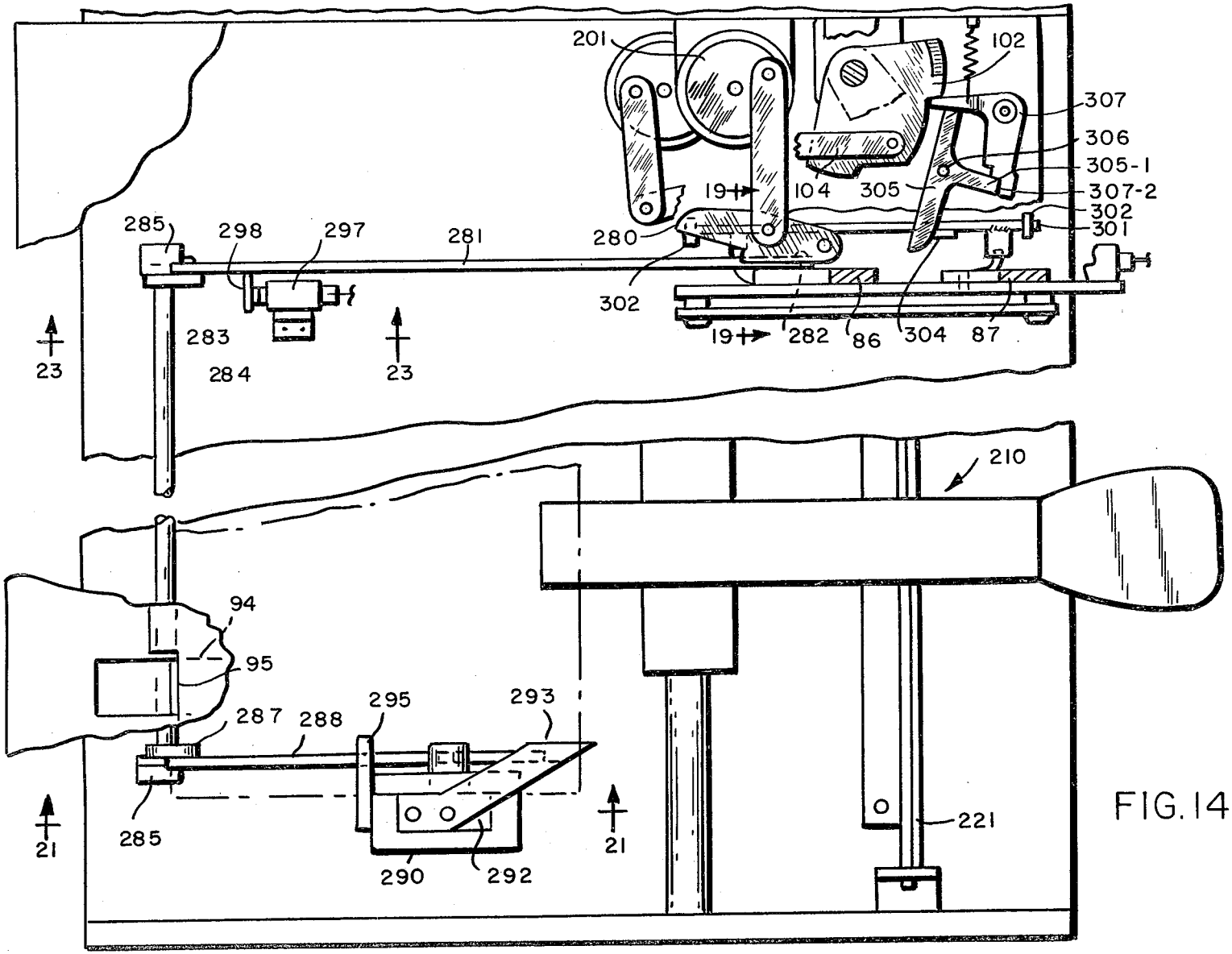
FIG. 14 is a plan view similar to FIG. 7 showing the vote lever being actuated.

The vote lever 86 is manually movable to the right by the voter if he or she is satisfied with their selections. The vote lever 86 is free to move because solenoid 201 has been energized by the same circuit conditions that turn on the "Select Candidates" light. Solenoid 201 disengages the locking pawl 280 from the vote lever 86 as shown in FIG. 14.

The vote lever causes the movement of an arm 281 pivotally coupled to it at 282. This arm has an end which is pivotally coupled to crank arm 283 fixedly supported by a shaft 284. The shaft 284 is supported for rotation by brackets 285. The shaft 284 has at its other end a similar crank 287 which is pivotally connected to a ballot cutter actuator arm 288 which causes the cut 50-2 to be made as shown in FIG. 2.

The cut 50-2 is made by the arm 288 (see FIG. 21) moving between a fixed roller 289 supported by the cutter housing 290 and a vertically movable cam follower roller 291.

The roller 291 is coupled to a plunger 292 which is guided in the cutter housing 290. At the top of the plunger 292 there is connected a cutter 293 which when lowered through the action of the arm 288 produces a corner cut against the matting cutter portion 294, as shown in FIG. 22.

The arm 288 is guided by a slotted plate 295 coupled to housing 290 as shown in FIG. 14. The plunger 292 is held up by springs 296 as shown in FIGS. 11 and 21. At 297 there is shown a switch (SW4) which is actuated by a pin 298 coupled to arm 281. This switch controls the entry of the vote from the buffer storage register into the vote accumulating memory.

Figure 19:
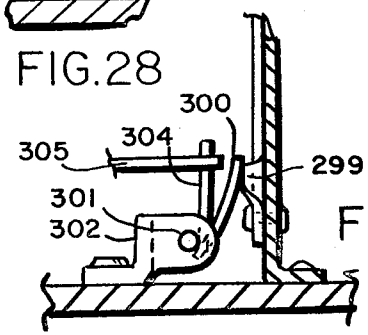
FIG. 19 is a sectional view taken along line 14—14 to illustrate the operation of the T shaped dog by the vote lever or void lever.

The vote arm 86 has as shown in FIG. 19 a cam protrusion 299 which rotates a leaf 300 which fixedly coupled to a rod 301 support for rotation by two end supports 302.

Figure 17:
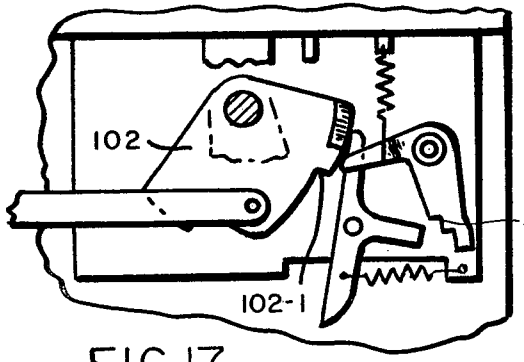
Figure 18:
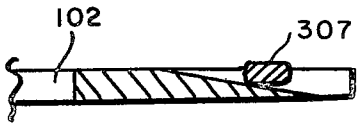
FIG. 18 is a sectional view taken along line 18—18 in FIG. 16 to show camming action of the lock lever.

The rod 301 has an upright projection 304 which engages a T shaped dog 305 pivotally connected at its center 306. The dog 305 locks the lever 85 in the vote position by engaging shoulder 102-1 (see FIG. 17.) At this time the dog end 305-1 is in the upper slot 307-1 of the pivotally mounted pawl 307. The pawl is urged clockwise by spring 308.

The vote lever 86 upon being moved to the right (see FIG. 14) causes the leaf 300 to rotate the rod 301 which moves the dog 305 through the projection 304 which cams it in a clockwise direction.

Thus the dog end 305-1 is moved to and locked in lower notch 307-2 (see FIG. 8) thereby permitting lock lever 85 to be rotated clockwise to return to its storing position. Note that disc 102 is now free to travel clockwise since dog has been moved clockwise to the position in FIGS. 8 and 14.

Figure 26:
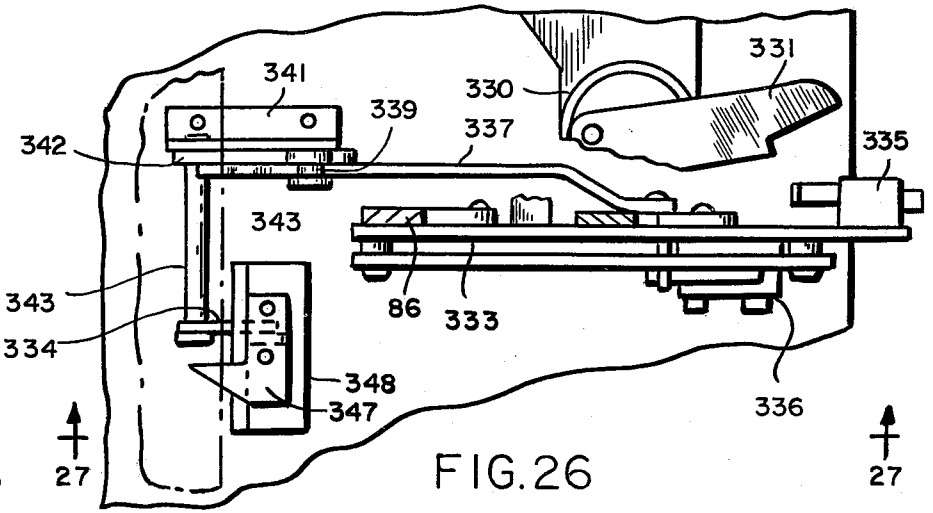
FIG. 26 is similar to FIG. 24 but only in the actuated position.

At this time reference should be had to FIGS. 6, and 7, and the more detailed views 24, 25, 26 and 27 for a description of the void lever 87 operation. Assuming that void solenoid 330 and its associated release lever 331 is positioned as in FIG. 26 to permit the void lever 87 to be moved to the left, the void lever 87 causes a void notch 50-3 to be formed in the ballot as shown in FIG. 3.

Figure 27:
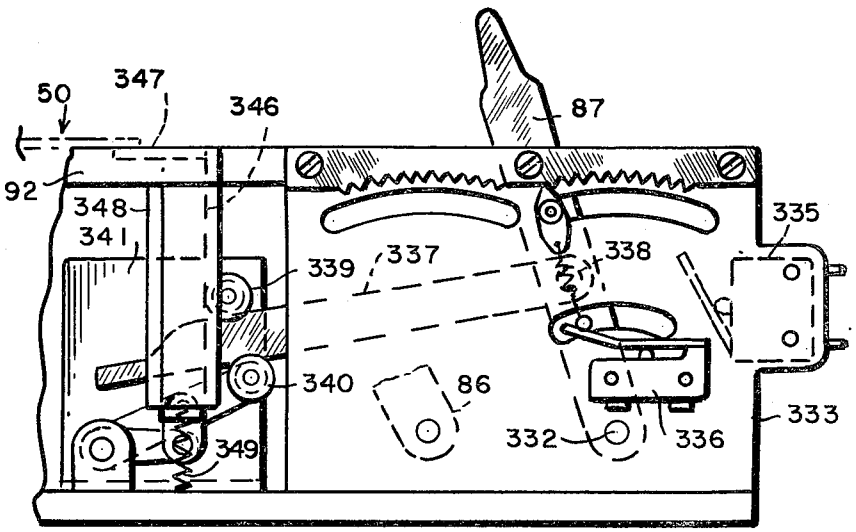
FIG. 27 is a sectional view taken along line 27—27 in FIG. 26.
Figure 24:
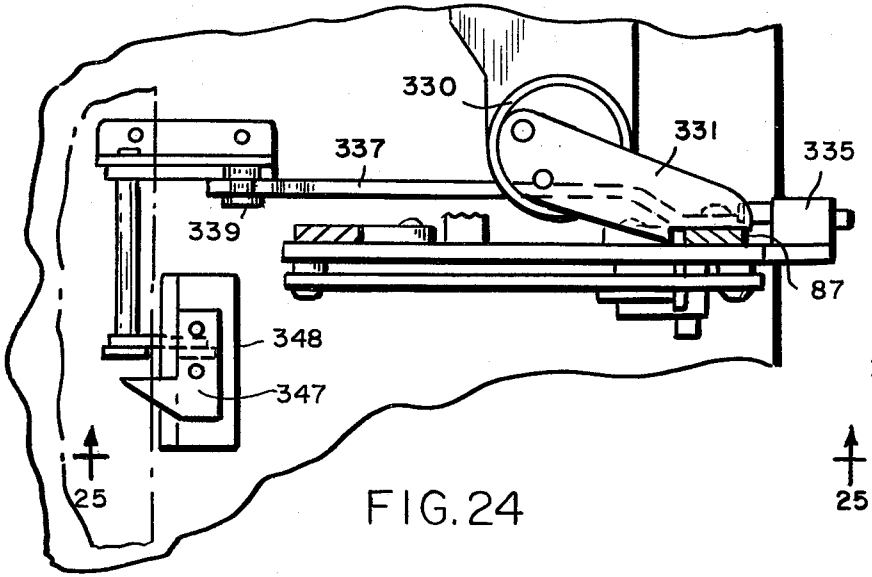
FIG. 24 is a plan view of the void lever mechanism.
Figure 25:
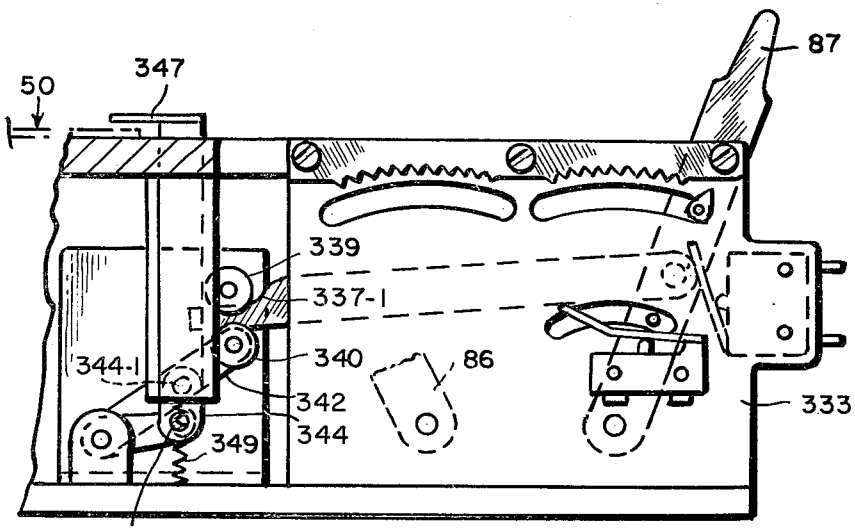
FIG. 25 is a sectional view taken alone line 25—25 in FIG. 24.

The void lever 87 is pivoted at 332 to an upright partition 333. Both the vote lever 86 and the void lever are pivoted to this partition 333 as shown in FIGS. 25 and 27. FIGS. 24 and 25 show the void lever 87 at rest. The void lever 87 has three functions namely: it operates a switch 335 (SW10), which permits solenoid 202 to withdraw pawl 331 if the voter wishes to void the ballot.

A switch 336 (SW5) is provided for producing a void signal to the output device and resets the buffer register and counter, and also has a mechanical linkage 337 pivoted at 338 on the lever 87 and with a cam surface 337-1 at the opposite end. The linkage 337 is positioned between two rollers 339 and 340, 339 being fixed to an upright support 341.

The movable roller 340 is attached to a crank arm 342 which is attached to a horizontal rod 343 which is pivoted at both ends to the base. Horizontal rod 345 has a short crank 334 at its other end. Crank 334 has a short link 344 which is pivoted at 345 and attached at 344-1 to a plunger 346 of a void cutter 347.

The plunger 346 is vertically movable in a housing 348 which is attached to the lower plate 92. The void lever 87 upon being moved to the left causes springs 349 holding the plunger 346 and cutter 347 above the ballot 50 as shown in FIG. 25 to be moved downwardly through the action of the cam 337-1 thereby forming the void notch 50-3.

The void lever 87 when moved to the left to void the ballot also unlatches the lock lever 85 to permit to be rotated to the left.

It should be understood that either the vote or void lever must be operated in order to release the lock lever after a ballot 50 has locked in place for voting.

Figure 8:
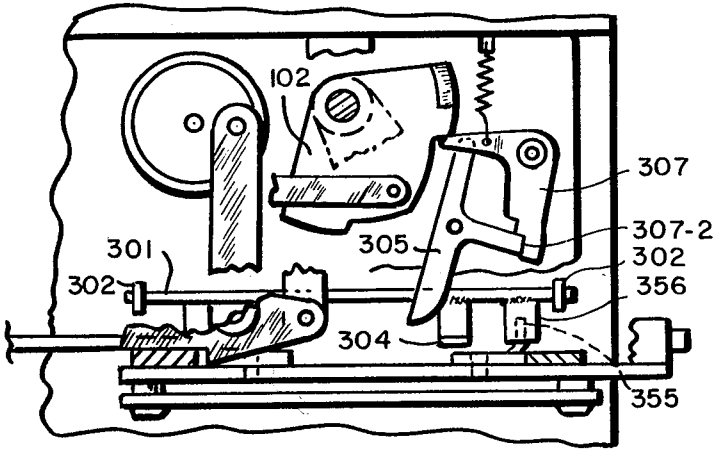
FIG. 8 is a top view of a portion of the lock lever mechanism after vote or void lever is actuated to release the lock lever.
Figure 30:
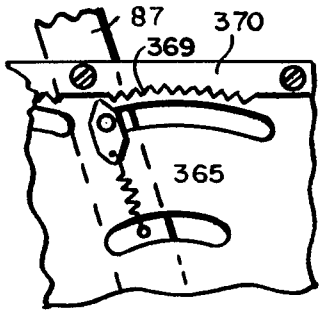
FIGS. 28-30 are views which illustrate the one way swing to prevent return prior to completion of stroke of the vote or void levers.

The void lever 87 as shown in FIG. 8 includes cam surface 335 attached thereto. The cam surface 335 operates a cam follower or finger 356 attached to the aforementioned rod 301 which is also operated by vote lever 86.

Upon movement to the left, the void lever causes the rod 301 to be rotated to cause the finger 304 to contact the T shaped dog 305 thereby unlatching the lock lever in the same manner as the vote lever accomplishes the unlatching of the lock lever.

At this time reference should be had to FIGS. 28–30 and FIGS. 12 and 13 which illustrate the full stroke mechanism to require that vote and void levers 86 and 87 and the punch 210 be moved completely in one direction before they are permitted to return.

Figure 28:
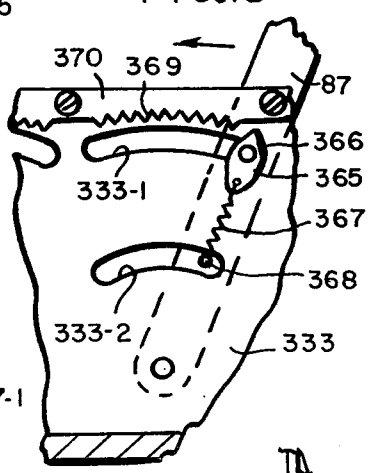
Figure 31:
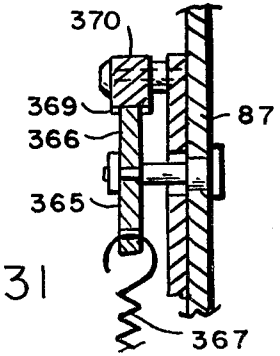
FIG. 31 is a sectional view taken along line 31—31 on FIG. 29.

FIG. 28 shows the void lever 87 at rest. The void lever has a pointed pawl 365 pivoted to it by pin 366 which extends through a slot 333-1 in plate 333. The pawl 365 has a spring 367 connected to it and to a pin 368 coupled to the lever 86 through a slot 333-2.

Figure 29:
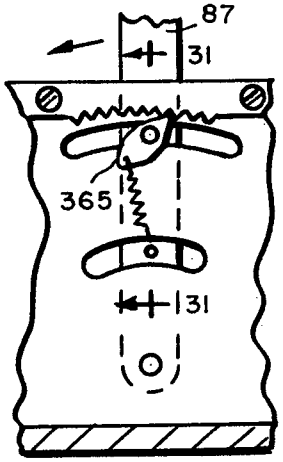

The pawl 365 engages teeth 369 of a bar 370 coupled to plate 333. When rotated, the lever 87 as shown in FIG. 29 causes from being moved to the right of FIG. 29.

In FIG. 13 a full stroke mechanism is also shown. Teeth 380 are provided on member 222 which mate with a pawl 381 mounted for rotation on plate 232 and held in place by a spring 382.

For convenience, only in FIGS. 12,13, and in more detail in FIGS. 13E and 13F, there is shown a rough indexing guide mechanism 700 for roughly locating the voting punch 210. The guide mechanism comprises supports 701 mounted on 226 having teeth 702-1 on an upper member 702.

A member 703 is pivotally coupled to plate 233 and is spring loaded by spring 704. A pin 705 is provided which rides over the teeth and is positioned in the cavities between teeth which correspond to punch or voting positions corresponding to the row of holes 224 and the corresponding magnetic switches.

Reference should be had to FIG. 4 and FIGS. 32 to 36 which shows logic for controlling the voting machine. In order to provide an understanding of the circuitry the following table should be referred to which identifies the switches and the corresponding solenoids for operating the various mechanisms.

SWITCHES AND THEIR RELATED RELAYS

| Text No. | SWITCH | |
|---|---|---|
| 150 | SWI | Card Bed Switch - RI |
| 160 | SW2 | Vote Corner Cut Switch - |
| 171 | SW3 | Transfers when Lock Lever reaches this position - R3 |
| 297 | SW4 | Transfers when Vote Lever reaches maximum travel to right - R4 |
| 336 | SW5 | Transfers when Void Lever reaches maximum travel to left - R5 |
| 170 | SW6 | Transfers momentarily just before Lock Lever reaches home position Does not stay transferred - R6 |
| | SW7 | Provides Maximum Vote Signal - R7 |
| | SW8 | Provides Over-Vote Signal - R8 |
| | SW9 | Transfers when Lock Lever leaves home position. Sole purpose is to disconnect Lock Lever solenoid after Lock Lever is released. No associated relay. |
| | SW10 | Transfers to operate Void Lever enable solenoid in the case where voter voluntarily voids ballot. |
| 48 | SW11 | Void notch corner cut (associated switch 48-2) |
| | SW12 | Coded hole valid ballot sensor. |
| | R9 | Invalid Ballot relay. |
| | R10 | Void solenoid enable relay. |
| | R11 | Vote solenoid enable relay |
| | R12 | Error flasher relay. Operates when either R7, R8 or R9 are up. |

Relays 4,5,6,7,8 are "latched" up thru their own points.

Assuming that a card or ballot 50 is placed in the machine, the card sensing switch SW1 is closed. This causes current to flow in solenoid coil R1. Current in coil R1 causes contacts R1-1, R1-2, R1-3 and R1-4 to close. The closure of R1-1 permits current to flow in solenoid coil 200 to unlatch the lever lock 85 so that it may be rotated, coil R1 being energized also turns on light 72 by moving R1-2 to the down.

Upon movement of the lock lever, switch SW9 (172) is opened and solenoid coil 200 is de-energized. At this time the card 50 is in place for voting. After the lock lever 85 is moved counterclockwise switch SW3 (171) is closed so that the card 50 can now be tested for the presence of a prior vote cut 50-2 and a void cut 50-3 to determine if the ballot is not in an invalid ballot.

Assuming that the prior vote notch 50-2 is present, SW2 will remain closed and current will flow in coil R2 which will cause R2-2 contact to be moved to the right which causes R9 to be energized. R9 being energized closes contacts R9-1, R9-2 and R9-3. When this occurs light 78 is flashed on and off because of contacts R9-3 causing a ringing circuit R12 and C1 to oscillate thereby periodically interrupting the current through R9.

Assuming that the ballot 50 is valid, SW2 (160) opens, R2-2 is moved to the left on its own since R2 has no current passing through it, and current flows in coil R3 which closes contact R3-3 to cause light 73 (select canadidates) to go on. When R3 is enabled R11-2 is energized and the vote lever solenoid 201 is energized so that the vote lever can now be used.

Figure 35:
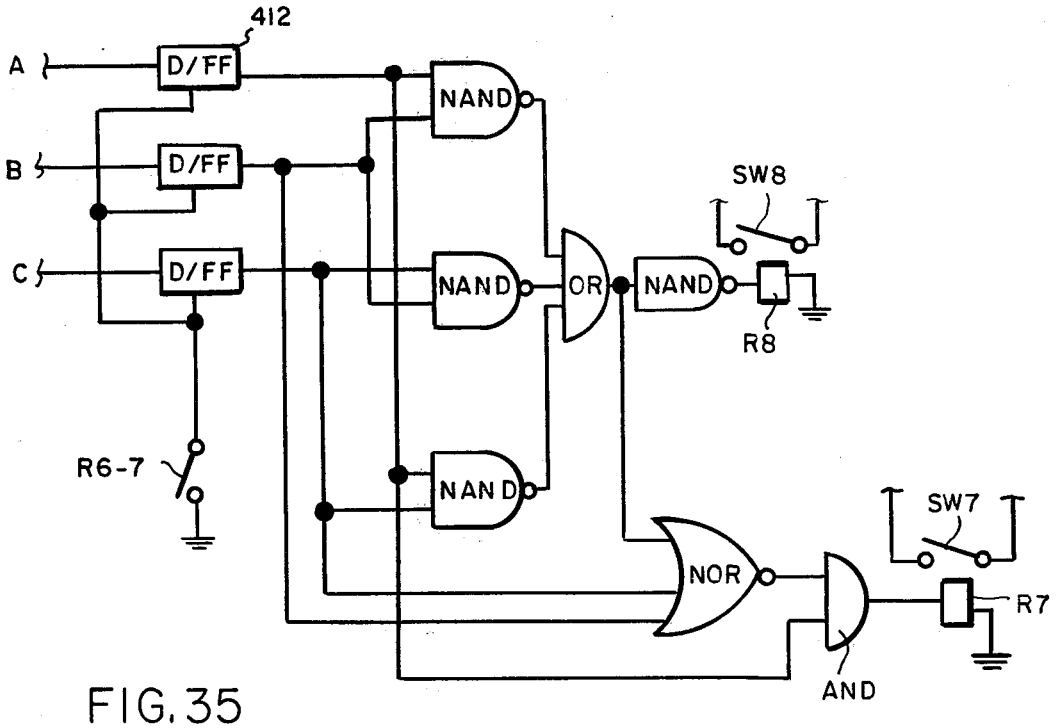
FIG. 35 illustrates typical logic for determining if there is an overvote, etc., condition.

Assuming that the maximum no. of candidates has been voted for, another part of the circuit to be described as shown in FIG. 35 closes switch SW7 which in turn energizes coil R7 and closes R7-2 and causes light 74 to turn on. R7-1 acts as a holding contact.

Figure 36:
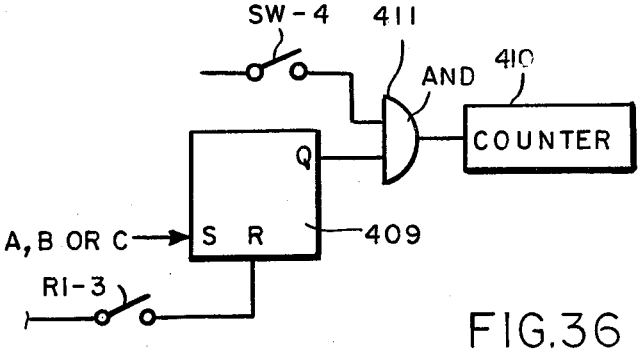
FIG. 36 illustrates a typical scheme to count the votes.

Assuming that SW8 is closed as will be described with reference to FIG. 36, when an overvote situation has occurred, then coil R8 is energized and closes R8-1 and moves R8-2 to the left to indicate an overvote to turn on light 79. Additionally, R8-3 is moved to left and turns on light 80. Further R8-4 is moved to the left and light 81 turns on. The movement of R8-2 to the left also energizes coil R10 which moves contact R10-2 to the left to energize solenoid coil 330 which permits the void lever to be operated.

It will be observed that R10-2 being moved to the left causes the vote lever to be locked because power is prevented from being supplied to the vote enable solenoid 201.

A switch SW11 (48) is also provided in parallel with switch SW2 and if a void notch is detected SW-2 will close after switch 48-2 closes (see FIG. 5C) and an invalid indication will be indicated by light 78 flashing on and off and the ballot is removed in the same manner as when a prior vote corner cut is detected.

Assuming that the vote made is acceptable to the voter, the vote lever 86 is moved to the right (see FIG. 14) to record the vote. When the vote lever reaches its maximum travel to the right switch SW4 (297) is closed which causes R4 to be energized which in turn causes light 76 to turn on through contacts R4-3. When the lock lever 85 is moved clockwise SW6 (170) momentarily closes which energizes coil R6 and hold contact R6-1.

Coil R6 closes contact R6-3 which turns light 77. If the void lever 87 is moved to the maximum left position, SW5 (336) is closed which energizes coil R5 which closes R5-3 and likewise turns on light 77.

Figure 33:
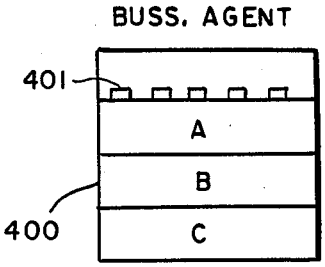
FIG. 33 illustrates a typical ballot used for voting for a single candidate e.g., a union business agent.
Figure 34:
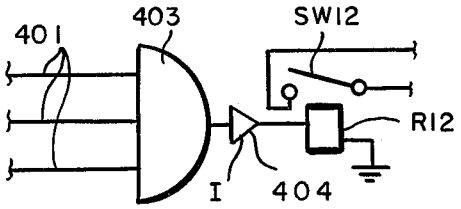
FIG. 34 illustrates typical logic for determining if the ballot is correct for the machine.

At this time reference should be had to FIGS. 33 to 35 for a description of the generation of signals to control switches SW12, SW7 and SW8. In FIG. 33 there is shown a typical ballot 400 for vote to elect a business agent, for example of a union, for which there are three candidates running for the office. Only one candidate may be selected. In addition, the ballot has three holes 401, similar to holes 52, in a row so that it can be determined by the sensors 130 that the ballot is proper for the machine. For example, with the twelve sensors shown in FIG. 9, three of them in position to sense the holes 401, are fed to an AND circuit 403 of FIG. 34.

If the output from AND circuit 403 and invertor 404 goes high after the ballot 400 has been locked in the machine and the holes 401 sensed SW12 will close to energize light 78 and the ballot 50 will have to be removed and voided. This is accomplished in the same manner as with switches SW2 and SW11 which advise the voter that the ballot must be voided and removed. In this manner it can be determined if the ballot 50 is correct for the machine.

In order to obtain the overvote signal to control SW8, the logic shown in FIG. 35 is used. If two candidates are voted for, switch SW-8 will close. This occurs because two holes punch two of A, B and C will go high and produce a high signal to energize coil R8. The inputs A, B and C are obtained from the magnetic reed switches 236 actuated by punch action. The inputs A, B and C represent a hole being made in the ballot portion A, B or C 400 to vote for candidates A, B, or C. After a single candidate has been selected the contacts of SW7 will be closed via the logic coupled to SW7 as shown in FIG. 35.

Figure 32:
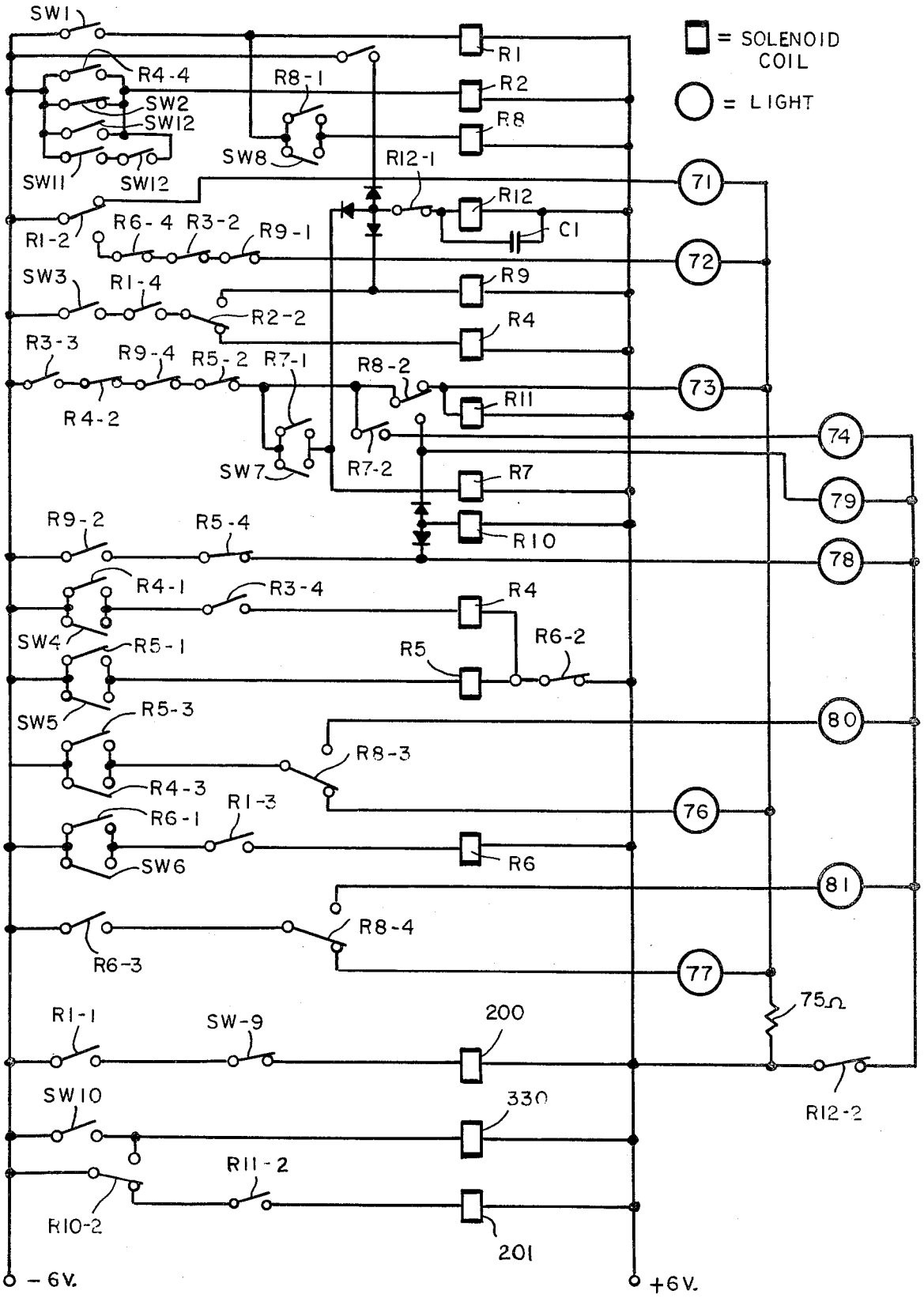
FIG. 32 is a diagram illustrating a portion of the electrical circuitry of the voting system.

The above signals A, B and C are also coupled to set terminal of a D flip/flops to set it upon closure of associated reed switch and these flip/flops are reset from the switch R6-7 closed by coil R6 in FIG. 32.

In this machine votes are stored in the buffer register comprising a D flip/flop 412 until the vote lever is activated. Upon activation of the vote lever, SW4 will close to cause the vote to be transferred as shown in FIG. 36 to a counter 410 via AND circut 411. This is a single counter and buffer register for each candidate.

The buffer flip/flops 409 are reset (cleared) when ever a ballot 52 is inserted and SW-1 closes R1-3. While the above is performed with hand wired logic, the functions are performable with a computer such as a microprocessor or minicomputer.

In similar situations the coded holes 401 would be used as instructions to set up the logic as previously described and in this manner the signals required may be developed.

We claim:

1. A voting machine comprising first means for receiving a ballot to be voted, second means for locking a ballot in place for voting after the ballot has been received by said first means, third means for determining if a ballot is valid for the machine after it has been locked into place by said second means, means for voting on said ballot made operative by said ballot being locked into place by said second means, said voting means comprising a punch to provide a hole in said ballot in response to each vote by actuation of said punch, said punch being mounted to allow movement along the length of said ballot to allow a series of holes each corresponding to each vote to be punched on said ballot, the position of said punch being such that each hole appears next to a voting option on said ballot, fourth means responsive to said punched holes for indicating to a voter that the maximum number of options have been voted on the ballot, fifth means responsive to said punched holes for indicating to a voter that too many options have been voted on the ballot, sixth means for invalidating the ballot by providing a prescribed mark thereon, buffer storage registers for electrically storing the vote on said ballot in response to the holes produced in said ballot by said voting means, electronic vote accumulating means, and seventh means enabled by said fifth means where too many options have not been voted on the ballot for transferring the stored vote from the buffer storage registers to said vote accumulating means in response to actuation of said seventh means, the actuation of said second means being permitted to release the ballot from the machine only after the ballot vote has been registered in response to said seventh means or the ballot has been invalidated in response to said sixth means.

2. The voting machine of claim 1 in which said buffer storage registers comprise electrical detection means responsive to the depression of said punches for storing in said buffer storage registers the number of holes made in the ballot by said voting means.

3. The voting machine according to claim 1 in which said electronic vote accumulating means comprises electronic counter means for counting the vote in response to actuation of said seventh means.

4. The voting machine according to claim 3 in which said seventh means causes an identifiable mark to be made on the ballot to indicate that it has been voted.

5. The voting machine according to claim 4 in which said sixth means causes an identifiable mark to be made on the ballot to indicate that the ballot has been invalidated.

6. The voting machine of claim 5 in which said sixth and seventh means comprises means for cutting out a different portion of said ballot, respectively.

7. The voting machine of claim 6 in which said second means locks the ballot until either the sixth or seventh means in response to actuation of said voting means causes one of said marks to be made on said ballot and to which marks said second means is responsive to unlock said ballot.

8. In a voting machine as in claim 1 using a ballot, means for detecting if the ballot is valid or invalid in response to predetermined encoded holes in said ballot, said means determining if the ballot is encoded properly for the voting machine into which it is inserted and providing a visual signal to indicate if the ballot is valid or invalid.

9. In the machine of claim 8 comprising in addition means for determining if the ballot has been invalidated or previously voted in response to different predetermined cut-out portions of said ballot.

10. A voting machine of claim 1 for use with a ballot which is used to record votes comprising in addition means for guiding the ballot into place for voting, and means responsive to predetermined marked portions of said ballot for determining if the ballot has been previously voted or previously voided after it has been guided into place for voting by said guiding means.

11. The machine of claim 10 in which said ballot marking responsive means comprises means for sensing the removal of a ballot portion indicating that the ballot has been previously voted or voided.

12. The machine of claim 11 in which said sensing means comprises sensor means for indicating the presence or absence of portions of the ballot.

13. A voting machine of claim 1 for use with a ballot which is used to record votes, comprising means for determining if the ballot has been previously voided or previously voted and means responsive to said determining means for permitting voting of the ballot if the ballot has not been previously voted or voided.

* * * * *